United States Patent [19]

Taitel et al.

[11] 3,939,032

[45] Feb. 17, 1976

[54] WEB BUTT SPLICER

[75] Inventors: Charles M. Taitel, Parsippany; Ralph L. Ryan, Lake Parsippany, both of N.J.

[73] Assignee: Compensating Tension Controls, Inc., Orange, N.J.

[22] Filed: Dec. 27, 1974

[21] Appl. No.: 536,726

[52] U.S. Cl. ..... 156/505; 156/159; 156/269; 156/518; 242/58.4

[51] Int. Cl.[2] ..... B31F 5/06

[58] Field of Search ..... 156/157, 159, 304, 502, 156/504, 505, 258, 269, 518, 519; 242/58.1, 58.4, 58.5

[56] References Cited

UNITED STATES PATENTS

| | | | |
|---|---|---|---|
| 3,627,616 | 12/1971 | Davis | 156/502 |
| 3,645,463 | 2/1972 | Helm | 156/506 |
| 3,654,035 | 4/1972 | Takimoto | 156/505 |

*Primary Examiner*—William A. Powell
*Assistant Examiner*—Brian J. Leitten
*Attorney, Agent, or Firm*—Gerald Durstewitz

[57] ABSTRACT

Web from a depleting roll of web in use is directed along a vertical line by rollers. A knife member is mounted for movement across the line and has a knife edge on its lower surface to cut the web. Vacuum ports are provided on each side of the knife member to hold the end of a spare roll which is trimmed flush with the knife edge. A piece of tape is applied to and overlaps the end of the spare web. The spare web end is positioned on the side of the knife member facing away from the line. A pair of cutting plates are positioned on opposite sides of the line below the knife and are movable vertically. Tape pressing bars are pivoted to the plates. The plate on the opposite side of the line from the knife is positioned with its top edge aligned with the knife edge. The other plate is spaced from the knife edge so that the bar acts against the tape applied to the spare web end. The web is stopped during the splicing operation by a clamp carried by the lower plate and by a pair of nip rolls locked against rotation. The knife member is moved across the line to cut the tape in use and butt the end of the spare web thereto. The tape press forces the tape against the cut end of the web in use. The clamp is released and the nip rolls unlocked. A second piece of tape held to one of the nip rolls by vacuum is applied to the other side of the splice as the web moves past the rolls.

10 Claims, 8 Drawing Figures

24
50
54
56
57
5
51
52
46
36
96
8
34
49
47
86
29
87
6
74
94
44
93
92
45
76
40
7
102
107
100
125
99
103
104
106
105
120
124
122
126
127
121

WEB BUTT SPLICER

BACKGROUND OF THE INVENTION

The present invention relates to web splicers and, more particularly, to splicers for butt splicing a spare roll of web onto web running from a depleting roll of web to provide a continuous supply of web to web-utilizing apparatus.

The prior art butt splicers generally have not been completely satisfactory for one or more reasons including excessive mechanical complexity, excessive cost of construction, need for duplicate parts to perform alternate splices, and failure to provide a strong splice. Some of the prior art butt splicer designs are disclosed in U.S. Pat. Nos. 2,987,108, 3,024,157 and 3,645,463 and in Australian Pat. No. 166,368 (1955).

SUMMARY OF THE INVENTION

It is an object of the present invention to provide an improved butt web splicer.

Another object is to provide such a splicer which is of simple, reliable and relatively inexpensive construction which performs efficiently and consistently produces a high quality strong splice.

The foregoing objects are accomplised by providing a butt splicer comprising a knife member positioned on one side of the line of running web being movable across the web and having means thereon for carrying the end of the spare web, a pair of plate members on either side of the line of running web carrying tape pressing means thereon and having end surfaces for cooperating with the knife member to cut the running web, means for moving the plate member opposite the knife member wherein its end surface is aligned with the cutting edge of the knife, means for moving the other plate member into a position wherein the tape pressing means thereon acts against a tape applied to and overlapping the end of the spare web carried by the knife member, means for stopping the running web during the splice, means for moving the knife member to cut the running web and butt the ends of the webs, and means for operating the tape pressing means to affix the tape across the splicer.

BRIEF DESCRIPTION OF THE DRAWINGS

A preferred embodiment of the invention has been chosen for the purpose of illustration and description and is shown in the accompanying drawings forming a part of the specification wherein.

DESCRIPTION OF THE PREFERRED EMBODIMENT

Figure 1:
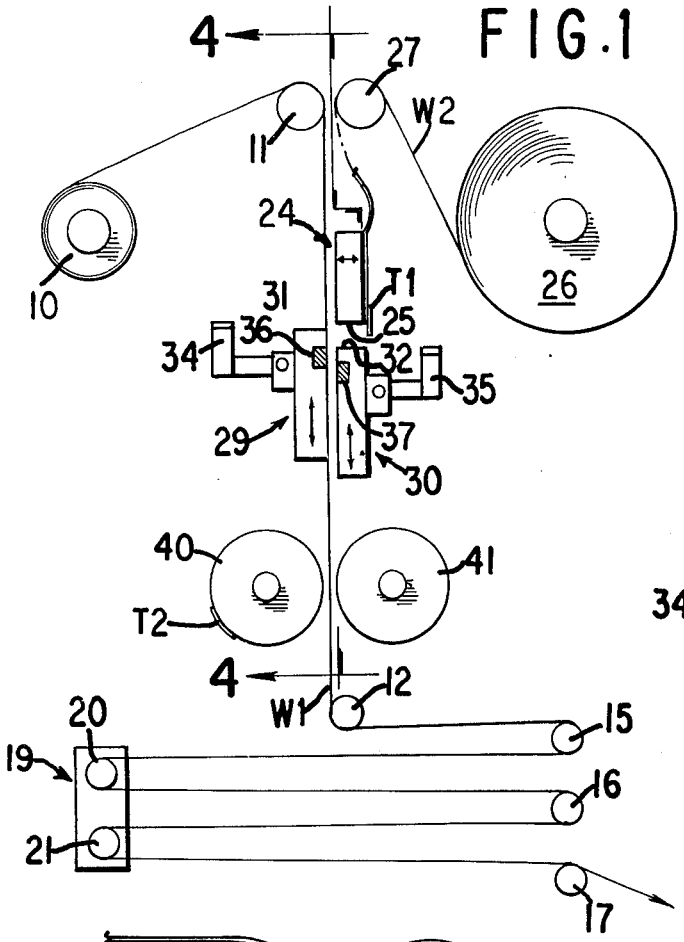
FIG. 1 is a schematic front view of a web butt splicer according to the present invention.

Referring to the drawings, FIG. 1 shows the general arrangement of a web butt splicer according to the present invention. The web in use, indicated on the drawings as W1 is drawn from a depleting roll of web 10 and is directed by a pair of rollers 11 and 12 along a vertical line running through the splicing head of the splicer. The web then passes through a web storage festoon 14 to the utilizing apparatus.

The festoon 14 includes three vertically aligned stationary rollers 15, 16, 17 and a festoon carriage 19 carrying a pair of vertically aligned rollers 20 and 21. As shown, the web passes in sequence over rollers 15, 20, 16, 21 and 17.

The festoon carriage is mounted for horizontal movement on rods or the like (not shown) and is biased away from the stationary rollers by a device such as a constant pressure air cylinder. During the splicing operation, motion of the web through the splicing head is stopped. The pull on the web exerted by the web-utilizing apparatus then draws the festoon carriage toward the stationary rollers. In this manner the web stored in the festoon is supplied to the utilizing apparatus during the splicing operation. A constant tension on the web leaving the festoon is maintained by an interconnection between a brake on the supply roll spindle and a lever actuated by motion of the carriage. The festoon and the tension controlling arrangement are not part of the present invention and are fully disclosed in copending application U.S. Ser. No. 477,857, filed June 10, 1974 and assigned to the assignee of the present invention. The above brief description of the festoon is included herein merely to provide a more complete understanding of the overall operation of the butt splicer.

The splicing head includes a knife member 24 positioned along side the vertical run of web between rollers 11 and 12, on the side of the web from the depleting roll. The member 24 is mounted to be movable horizontally across the line of the web. The lower surface 25 of the knife member is formed to provide knife edges for cutting the web. Vacuum ports are provided on each side of the knife member to hold the end of the web to be spliced to the web in use. The knife member is positioned on the opposite side of the vertical run of web from the roll of web 10. The spare web, indicated as W2 on the drawing, extends from a spare roll of web 26 over a roller 27 and is positioned on the side of the knife member facing away from the line of the web W1. The end of the web is manually trimmed to be flush with the surface 25.

A pair of vertically aligned cutting plates 29 and 30 are positioned on opposite sides of the vertical run of web below the knife member. The plates 29 and 30 are movable vertically and have upper end surfaces 31 and 32 which cooperate with the knife edges of the surface 25.

A section of tape T1 is manually applied to the spare web W2 so as to overlap the end thereof as shown in the drawing. A tape pressing bar 34, 35 is mounted on each of the outer surfaces of plates 29, 30 respectively, to pivot upwardly toward the opposite plate.

Prior to initiating the splice operation, the cutting plates are positioned as shown in the drawing (FIG. 1). The cutting plate 29 on the opposite side of the vertical run of web from the knife member is positioned so that its upper surface 31 is aligned with the surface 25 of the knife member. The cutting plate 30 directly below the knife member is positioned so that the press bar 35 strikes the overlapping portion of the tape T1 when pivoted toward the web W1 after that web is cut as described hereinafter.

Each of the plates 29, 30 carry a web-clamping pad 36, 37 for stopping the motion of the web during the splicing operation.

Below the plates 29, 30 the web passes between a pair of nip rolls 40, 41 which are normally spaced from each other. Before the splicing operation, these nip rolls are locked against rotation as described hereinafter in detail.

The basic operation of the butt splicer will now be briefly explained. The operation of each of the elements of the splicer is described in detail hereinafter. Each of the elements of the preferred embodiment is actuated automatically by a pneumatic control system after a sensor has indicated the completion of a step or upon expiration of a time delay. When the splice is initiated, either manually by an operator or automatically by a device which senses the diameter of the roll of web in use, the clamp pad 37 is extended to press the web against the plate 29, and, at the same time, the nip roll 40 is moved horizontally to clamp the web against the roll 41. A brake then stops the roll of web 10 from rotating to prevent the web from spilling onto the floor.

Figure 2:
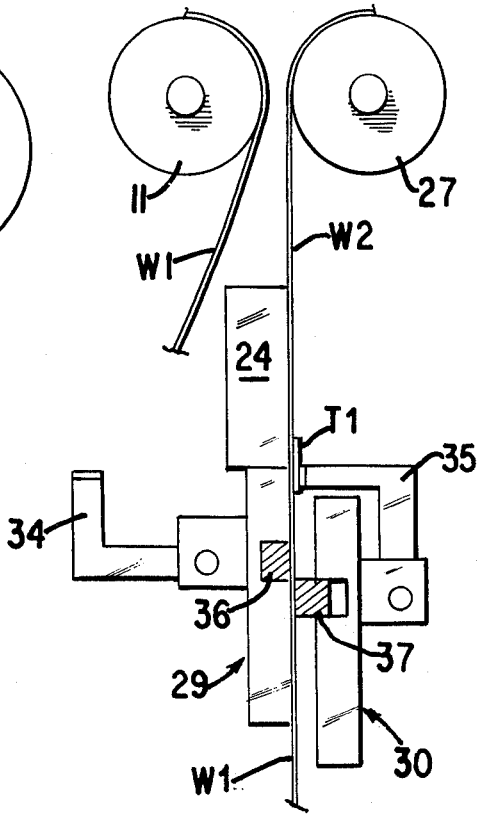
FIG. 2 is a schematic view of the splicing head of the splicer of FIG. 1 showing the webs being spliced.

The clamp pad 37 engages before the nip rolls, and the web is drawn taut before the nip rolls close. When the nip roll 40 is in clamping position, the knife member 24 is moved across the vertical line of web. The surfaces 25 and 31 cooperate to cut the web W1 and the end of the web W2 is aligned with the end of the web W1 as seen in FIG. 2. The tape press bar 35 is then actuated and presses the tape T1 against the end of the web W1 to splice the two webs together. The tape press bar 35 is retracted, the clamp pad 37 retracts and the nip rolls are unlocked. The web is free to move downwardly, however, the nip rolls are still pressed against the web so that the rolls rotate at the same speed as the web.

Figure 3:
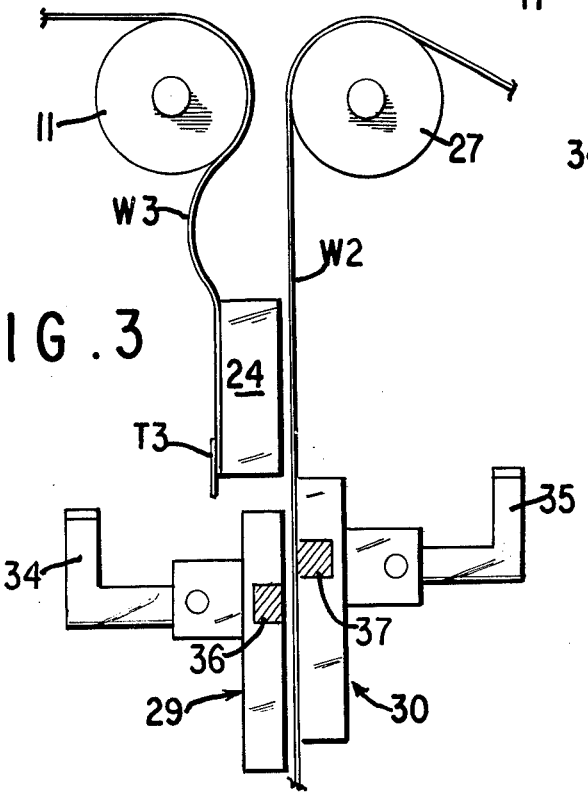
FIG. 3 is a view similar to FIG. 2 showing the head set up for the next splice.

Referring again to FIG. 1, a second strip of tape T2 was applied to the nip roll 40 by the operator prior to the initiation of the splice. The nip rolls are provided with vacuum ports to hold the tape T2 to its surface. The tape T2 is applied at a location so that as the splice passes between the rolls, the strip of tape is transferred to the spliced web across the splice line in alignment with the strip of tape T1. The junction of the webs is thus taped on both sides and the splice is completed. The nip roll 40 is then moved away from the roll 41, the plate 29 is moved downwardly, and the plate 30 is moved upwardly to prepare the splicer for the next splice when the roll of tape 26 is depleted. FIG. 3 shows the splicing head readied for the next splicing operation wherein a web W3 will be spliced to the web W2.

Figure 4:
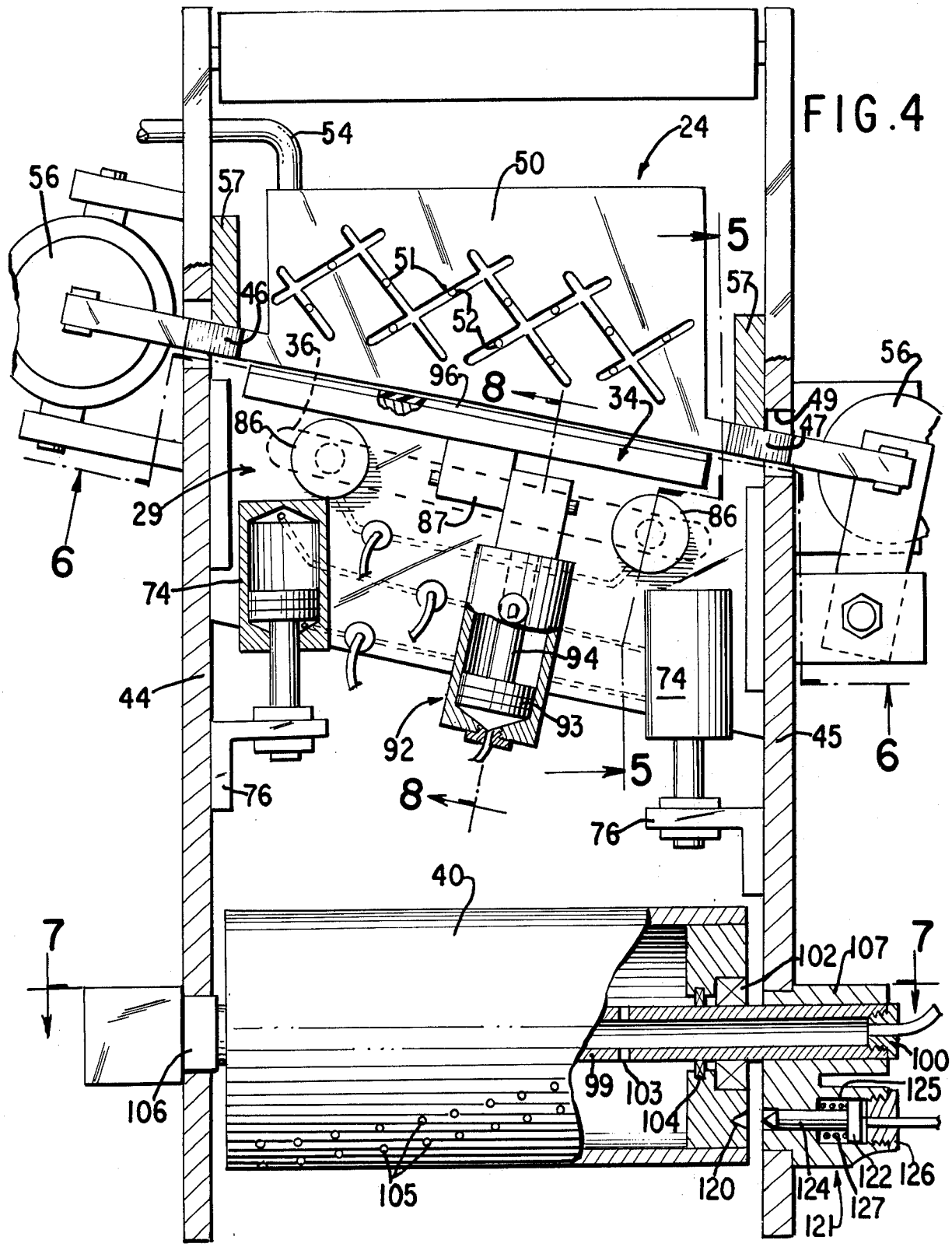
FIG. 4 is a sectional view of the splicing head taken along a line as indicated by the line 4—4 of FIG. 1.
Figure 5:
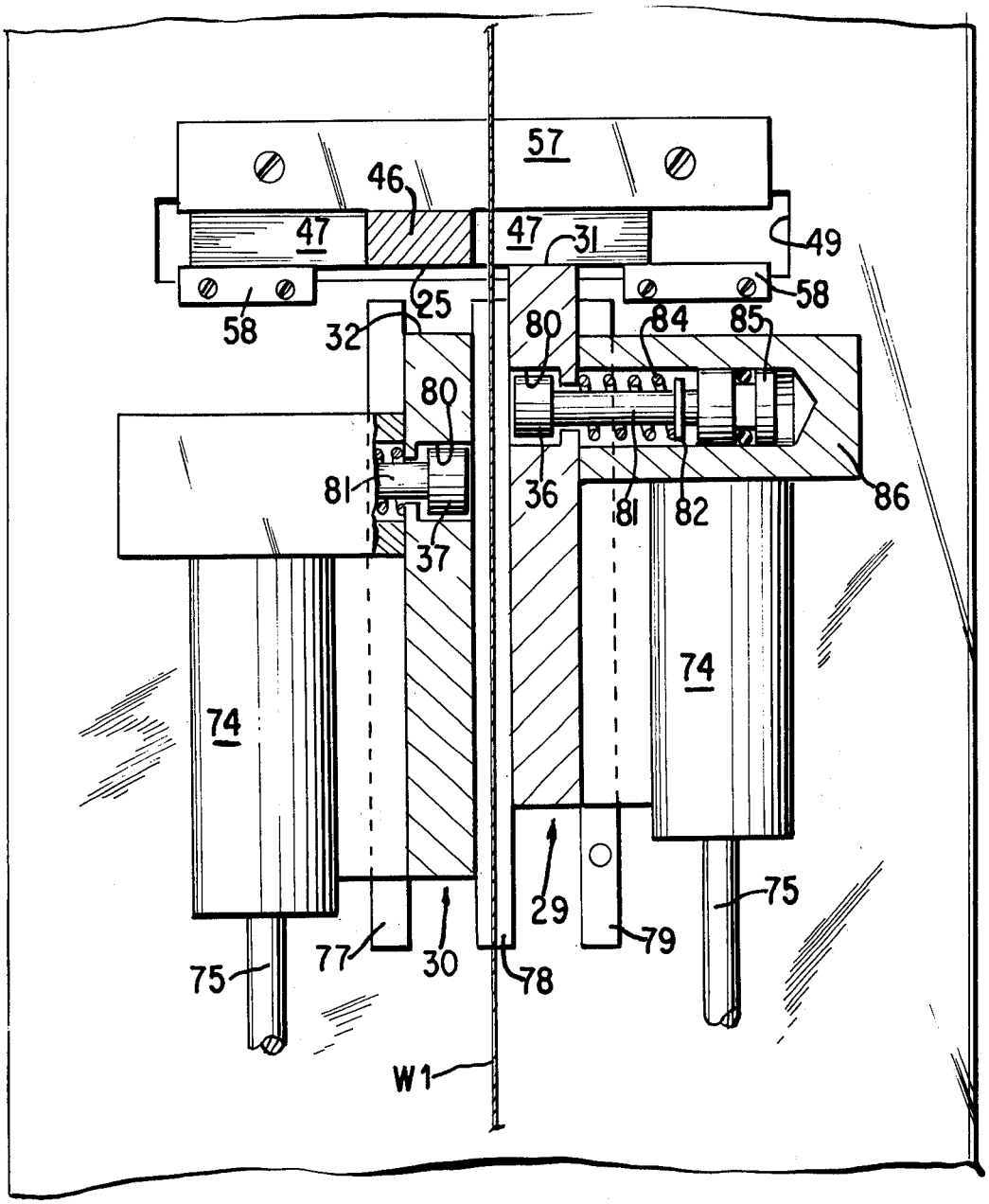
FIG. 5 is a sectional view taken along line 5—5 on FIG. 1 illustrating the web clamps on the cutting plates.
Figure 6:
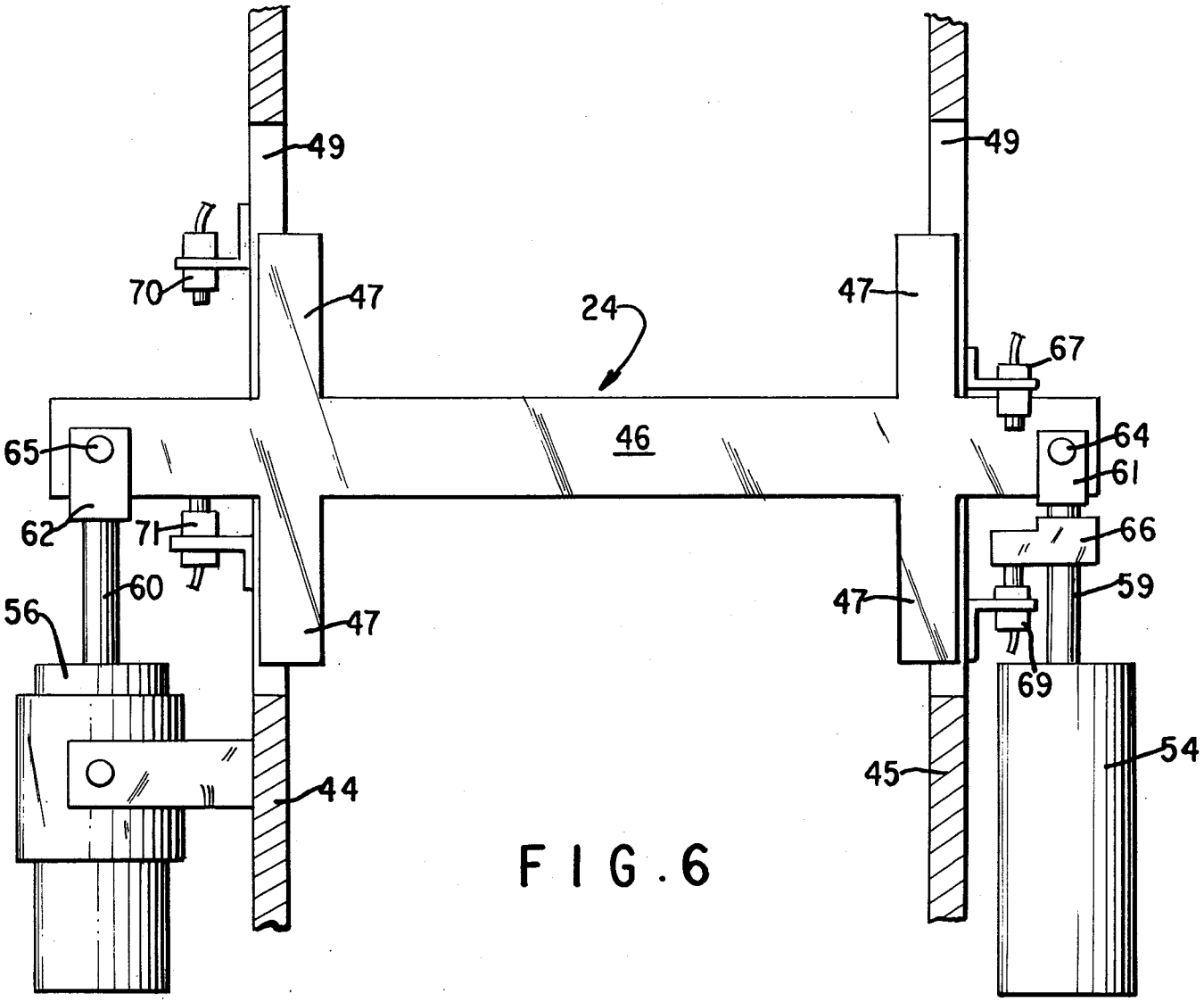
FIG. 6 is a sectional view taken along line 6—6 on FIG. 1 showing the mechanism operating the knife member.

Referring now to FIGS. 4–8, the elements of the splicing head are mounted between a rear frame plate 44 and a front frame plate 45. The knife member 24 includes a bar 46 inclined at an angle with respect to the horizontal. A pair of arms 47 extend horizontally from the bar 46 and are perpendicular thereto within slots 49 in the frame plates 44 and 45 (FIG. 6). A hollow plate 50 extends upwardly from the bar 46 between the frame plates. Both sides of the plate 50 are formed with intersecting grooves 51 which are connected to the hollow center of the plate by holes 52. A flexible hose 54 connected to a port in the top of the plate leads to a vacuum pump to form a vacuum within the grooves 51 to hold the end of the spare web against the side of the knife member.

A pair of pneumatic actuators 54, 56 are connected to the ends of the bar 46 to move the knife member across the run of web W1. The actuator 54 is rigidly mounted to the frame plate 45 and the actuator 56 is pivotally mounted to the frame plate 44. The knife is guided by upper guide blocks 57 and lower guide blocks 58 (FIG. 5) which engage the arms 47.

The actuators 54 and 56 have piston rods 59 and 60 with "U" shaped brackets 61 and 62 mounted on the ends thereof. The brackets 61 and 62 are pivotally connected to the ends of the bar 46 by pins 64 and 65. A clamp 66 is mounted on the piston rod 59. A pair of pneumatic position sensors 67 and 69 mounted on the frame plate 45 cooperate with the clamp 66 to sense the position of that end of the bar 46. A pair of pneumatic position sensors 70 and 71 are mounted on the frame plate 44 to cooperate with the sides of the bar 46 to sense the position of the second end of the bar.

One type of pneumatic position sensor which may be used generates a back pressure in the pneumatic control circuit when it is contacted by the body whose position it detects. In this type of device, pressurized air is delivered to the unit and is allowed to escape through a vent hole in the end of the unit. When a body is moved into contact with that end of the unit, the flow of air through the vent hole is restricted and pressure builds up in the pneumatic circuit which operates a valve to initiate the next step.

As shown in FIGS. 4 and 5, the cutting plates 29 and 30 are each moved vertically by a pair of pneumatic actuators 74 mounted thereon having piston rods 75 locked to brackets 76 mounted on the frame plates. The plates 29 and 30 are guided by vertical bars 77–79. The inner faces of the cutting plates are each formed with a deep groove 80 in which the web clamping pads 36 and 37 are positioned. The ends of the clamping pads are secured to shafts 81 having a split washer 82 mounted near the outer end thereof. A spring 84 surrounds each shaft 81 and presses against the washer 82 to hold the clamping pads within the grooves 80. A pneumatic piston 85 is mounted within a cylinder 86 surrounding the shaft 81 and acts against the end of the shaft 81 to extend the clamping pads when it is desired to clamp the web.

Figure 8:
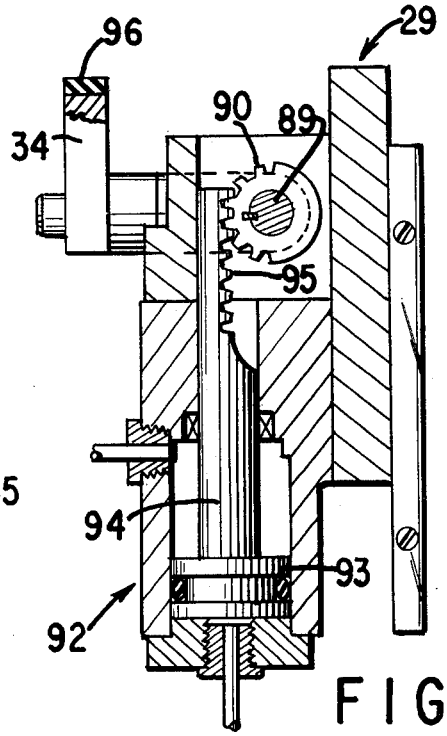
FIG. 8 is a sectional view taken along the line 8—8 on FIG. 1 illustrating the tape pressing bar mechanism.

Referring to FIGS. 4 and 8, the tape pressing bars 34, 35 are each mounted on an arm 87 which is locked to a shaft 89. A gear 90 within a housing 91 is keyed to the shaft 89. A pneumatic actuator 92 is mounted on the cutting plate and has a piston 93 with a piston rod 94 in which gear teeth 95 are cut. The gear teeth 95 engage the teeth of the gear 90 to rotate the shaft 89 when the actuator 92 is energized. A resilient pad 96 is mounted to the edge of the pressing bar for contact with the web.

Figure 7:
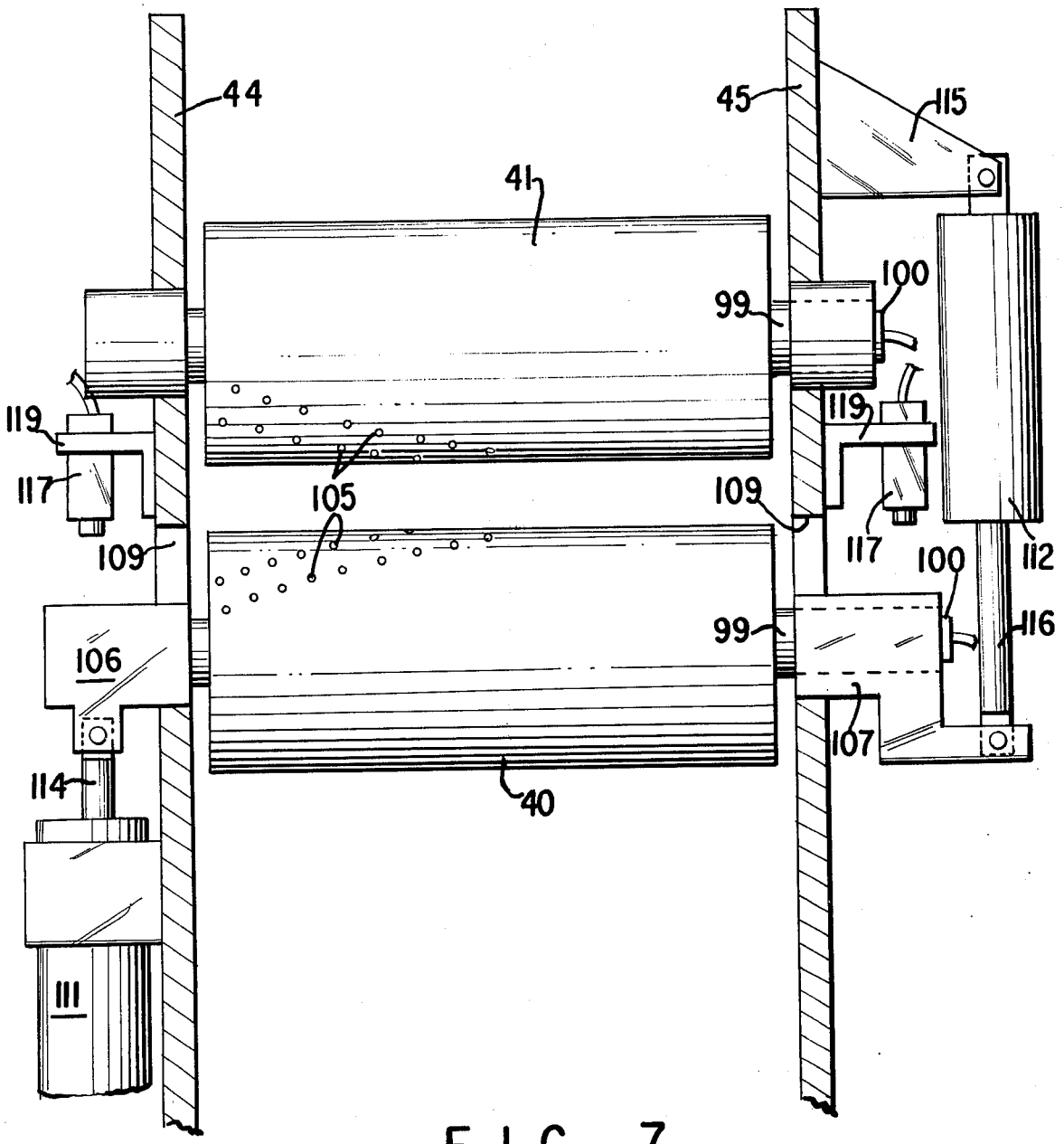
FIG. 7 is a sectional view taken along line 7—7 on FIG. 1 showing the mechanism for closing the nip rolls.

As shown in FIGS. 4 and 7, the nip rolls 40 and 41 are mounted on tubular shafts 99 which are connected to a vacuum pump through a fitting 100 at one end thereof. The rolls are hollow and have end plates 101 mounted for rotation about the shafts 99 on bearings 102. Ports 103 in the shafts 99 communicate with the interior of the hollow rolls and seals 104 are provided at each bearing to maintain the vacuum. A double row of holes 105 are helically positioned in the outer wall of each roller to hold the tape strip T2 to the selected roll prior to splicing. The angle of the rows of holes 105 are such that when the tape strip T2 is transferred to the web, the strip T2 is at the same angle as the cut end of the web.

The ends of the shaft 99 of the roll 40 are mounted in rectangular sliding bearings 106 and 107 which are positioned in slots 109 and 110 in the frame plates. The roll 40 is moved toward and away from the roll 41 by a pair of pneumatic actuators 111 and 112. The actuator 111 is mounted on the frame plate 44 and its piston rod 114 is connected to the sliding bearing 106. The actuator 112 is mounted on one end to a bracket 115 secured to the frame plate 45 and its piston rod 116 is connected to the sliding bearing 107. A pair of pneumatic sensors 117 are mounted to the frame plates by brackets 119 facing the sliding bearings 106 and 107.

The nip roll end plates 101 which face the frame plate 45 are provided with conical recesses 120. Beneath each of the shafts 99 is mounted a pneumatically actuated stop assembly 121 for cooperating with the recess 120 to lock the rolls 40 and 41 against rotation. As shown in FIG. 4, the stop assembly 121 of the roll 40 is built into the sliding bearing 107. A piston 122 connected to a pointed rod 124 is positioned in a stepped bore 125 in the bearing 107. A pneumatic fitting 126 is positioned in the end of the bore 125 to supply pressure for extending the rod 124. A spring 127 retracts the rod when the pressure on the piston is removed. The stop assembly locking the roll 41 is similarly constructed and mounted in a block (not shown) set into the frame plate 45.

When the operator has prepared the splicer for a splicing operation (by loading a spare supply roll, positioning and trimming the end of web W2, and applying the tape strips T1 and T2), he operates a valve which directs pressurized air to the stop assemblies 121 to force the rods 124 against the roll end plates 101. He then rotates the nip rolls to align the pointed ends of the rods 124 with the conical recess 120. The rolls are then locked against rotation.

Upon initiation of the splice cycle, air under pressure is directed into the web clamping cylinders 86 (FIG. 5) mounted on the cutting plate 29. The pistons 85 are driven against the rods 81 on either end of the clamp pad 36 and the pad moves out to clamp the web W1 against the face of the plate 30. At the same time, air under pressure is directed to the nip roll actuators 111, 112 (FIG. 7) to slide the nip roll 40 against the roll 41 and clamp the web W1 therebetween.

The sensors 117 are contacted by the surfaces of the bearings 106 and 107 and produce a pneumatic signal which causes air pressure to be directed to the knife member actuator 54 (FIG. 6). The actuator 54 is energized to extend the piston rod 59 and the knife member is pivoted about the pin 65. As the knife pivots, the web is sliced from one edge toward the other. At the end of the stroke, the clamp 66 contacts the sensor 67 and a signal is sent to actuate the actuator 56 to extend the piston rod 60. The second end of the knife member moves across the line of the web and the side of the bar 46 contacts the sensor 70. A signal is transmitted indicating the cut has been made and the ends of the webs W1 and W2 are in abutting relationship. An air pressure pulse is directed to one side of the piston 93 of the actuator 92 controlling the press bar 34. The bar 34 strikes the tape strip T1 pressing it against the end portion of the cut web W1. A second air pressure pulse is directed to the other side of the piston 93 to retract the bar 34. The bar 34 strikes the tape strip T1 pressing it against the end portion of the cut web W1. A second air pressure pulse is directed to the other side of the piston 93 to retract the bar 34.

The pressure acting on the stop assemblies 121 locking the nip rolls and the pressure acting on the pistons 85 holding the clamp pad 36, are then vented. The springs 127 retract the pins 124 freeing the nip rolls, and the springs 84 retract the clamp pad 36. The web, now free to move, rotates the nip rolls. On the nip roll 40, the locking conical recess 120 is positioned with relation to the double row of holes 105 so that the tape strip T2 reaches the junction point of the rolls at the same time the butted ends of the spliced webs passes between the rolls. The tape T2 is thus pressed across the back side of the splice and engages the ends of each of the spliced webs to complete the splice.

After a time delay, the nip roll actuators 111 and 112 are actuated to move the roll 40 away from the roll 41. The actuators 74 are also energized to reverse the positions of the cutting plates 29 and 30. The splicer is thus placed in condition to be prepared by the operator for the next splice when the roll 26 nears depletion.

What is claimed is:

1. Apparatus for butt splicing the end of web material from a spare roll to web material being drawn from a depleting supply roll comprising in combination a knife member mounted to be movable laterally between two operative positions on either side of a line having sides facing toward and away from said line in each of the operative positions and having an end perpendicular to said line providing a knife edge on each side of said knife member, means for directing the web in use along said line, means on each side of said knife member for securing the end portion of the spare roll web to that side thereof facing away from said line with the end of the spare web positioned along the knife edge on that side, a pair of plate members on either side of said line movable parallel to said line and each having an end parallel to and facing said end of said knife member, means for moving the plate member on the opposite side of said line from the knife member to align said end thereof with said end of said knife member to cooperate therewith in severing the web in use, tape pressing means mounted on each of said plate members, means for moving the plate member on the same side of the line as the knife member to operatively position said tape pressing means thereon, means for stopping the movement of the web along said line, means for moving the knife member across said line while the web is stopped to cut the web in use and butt the end of the spare web thereto, and means for operating said operatively positioned tape pressing means while the web is stopped to press the overlapping portion of a tape applied to and overlapping the web end carried by the knife member against the cut end of the web in use to splice the spare web thereto.

2. Apparatus according to claim 1, wherein said means for stopping the movement of the web along said line includes a pair of spaced rolls, means for locking said rolls against rotation during the splicing operation, means for moving one of said rolls to press said web between said rolls during the splicing operation to stop the web, and means for unlocking said rolls to allow rotation thereof after the splicing operation.

3. Apparatus according to claim 2, wherein said means for stopping the movement of the web along said line also includes a clamp member mounted on each of said plate members each for clamping the web against the opposite plate member, and means for operating one of said clamp members during the splicing operation.

4. Apparatus according to claim 2, including means for holding a second piece of tape to said roll on the opposite side of said line of web from the initial position of said knife member.

5. Apparatus according to claim 1, wherein said knife member is mounted to pivot about its ends, and said means for moving said knife member across said line includes a pair of actuators energized at different times and operating at spaced points on said knife member to pivot said knife member about each of its ends in turn.

6. Apparatus according to claim 1, wherein said knife member is formed with vacuum ports on the sides thereof parallel to the running web for gripping the end of the new web.

7. Apparatus according to claim 4, including a line of vacuum ports in the surface of each of said rolls for holding the second tape strip thereto.

8. Apparatus according to claim 7, wherein said knife means is positioned to cut the running web at an acute angle and said line of vacuum ports is positioned to deposit the second tape strip on the splice at the same angle.

9. Apparatus according to claim 2, wherein one of said rolls is mounted for movement perpendicular to its axis, and both of said rolls are provided with a recess in one end thereof, said locking means including a pin for engaging said recess to prevent rotation of said rolls, means for moving said pins into said recess, and means for retracting said pins.

10. Apparatus according to claim 1, wherein each of said tape pressing means include a bar for contacting the tape, a shaft mounted on the plate member, an arm rotatably mounted on the shaft, said bar being mounted on the arm, and an actuator mounted on the plate member to rotate the shaft and pivot the arm to move the bar toward the opposite plate member.

* * * * *